US006851271B2

(12) United States Patent
Upton et al.

(10) Patent No.: US 6,851,271 B2
(45) Date of Patent: Feb. 8, 2005

(54) REFRIGERATED MERCHANDISER WITH FOUL-RESISTANT CONDENSER

(75) Inventors: Ronald D. Upton, Spartanburg, SC (US); Harry A. Brancheau, Inman, SC (US); Robert J. Reese, Spartanburg, SC (US); E. Duane Daddis, Jr., Manlius, NY (US); Timothy J. Roberts, Spartanburg, SC (US)

(73) Assignee: Carrier Commercial Refrigeration, Aurora, IL (US)

( * ) Notice: Subject to any disclaimer, the term of this patent is extended or adjusted under 35 U.S.C. 154(b) by 0 days.

(21) Appl. No.: 10/421,575

(22) Filed: Apr. 23, 2003

(65) Prior Publication Data

US 2003/0213259 A1 Nov. 20, 2003

Related U.S. Application Data

(60) Provisional application No. 60/376,486, filed on Apr. 30, 2002.

(51) Int. Cl.[7] ..... A47F 3/04

(52) U.S. Cl. ..... 62/246; 62/255; 62/440; 62/507; 165/122

(58) Field of Search ..... 62/246, 255, 378, 62/440, 507, 302; 165/121, 122, 150

(56) References Cited

U.S. PATENT DOCUMENTS 2,130,092 A * 9/1938 Kettering ..... 62/285
2,150,224 A * 3/1939 Hull ..... 62/95
4,135,369 A * 1/1979 Allgeyer et al. ..... 62/251
4,387,578 A * 6/1983 Paddock ..... 62/127
4,949,554 A * 8/1990 Branz et al. ..... 62/248
4,977,754 A * 12/1990 Upton et al. ..... 62/248
5,590,541 A * 1/1997 Rainwater ..... 62/255
5,983,655 A * 11/1999 Kistner et al. ..... 62/208
6,286,325 B1 * 9/2001 Chiu et al. ..... 62/171
6,378,603 B1 * 4/2002 Shimoya et al. ..... 165/153
6,401,804 B1 * 6/2002 Shimoya et al. ..... 165/70
6,532,757 B2 * 3/2003 Holzer et al. ..... 62/331

FOREIGN PATENT DOCUMENTS

JP 406341736 A * 12/1994

* cited by examiner

*Primary Examiner*—William E. Tapoalcai
*Assistant Examiner*—Mohammad M. Ali

(57) ABSTRACT

A refrigerated cold beverage merchandiser (10) includes an enclosure defining an insulated, refrigerated display cabinet (25) and a compartment (30) heat insulated therefrom wherein a compressor (40) a condenser (50) and a condenser fan (60) are disposed. The condenser (30) is formed by a plurality of in-line tube banks (52). Each tube bank (52) is a serpentine tube formed a plurality of parallel straight tube segments (54) extending in horizontal rows (55) between a pair of spaced, opposed end plates (58) and elbow turns (56) connecting neighboring straight tube segments (56) in a conventional manner. Each successive tube bank (52) is aligned with the other tube banks so that respective parallel tube rows (55) are disposed in-line from the front to the rear of the condenser (50).

2 Claims, 3 Drawing Sheets

REFRIGERATED MERCHANDISER WITH FOUL-RESISTANT CONDENSER

This application claims priority of provisional patent application Ser. No. 60/376,486, filed on Apr. 30, 2002.

TECHNICAL FIELD

The present invention relates generally to refrigerated cold beverage merchandisers and, more particularly, to a refrigerated cold beverage merchandiser having a condenser that resists airside fouling.

BACKGROUND OF THE INVENTION

Cold beverages, such as soft drinks, beer, wine coolers, etc. are commonly displayed in convenience stores, supermarkets and other retail establishments in refrigerated merchandisers for self-service purchase by customers. Conventional merchandisers of this type conventionally comprise a refrigerated, insulated enclosure defining a refrigerated product display cabinet and having one or more glass doors. The beverage product, typically in cans or bottles, single or in six-packs, is stored on shelves within the refrigerated display cabinet. To purchase a beverage, the customer opens one of the doors and reaches into the refrigerated cabinet to retrieve the desired product from the shelf Beverage merchandisers of this type necessarily include a refrigeration system for providing the cooled environment within the refrigerated display cabinet. Such refrigeration systems include an evaporator housed within the insulated enclosure defining the refrigerated display cabinet and a condenser and compressor housed in a compartment separate from and exteriorly of the insulated enclosure. Cold liquid refrigerant is circulated through the evaporator to cool the air within the refrigerated display cabinet. As a result of heat transfer between the air and the refrigerant passing in heat exchange relationship in the evaporator, the liquid refrigerant evaporates and leaves the evaporator as a vapor. The vapor phase refrigerant is then compressed in the compressor to a high pressure, as well as being heated to a higher temperature as a result of the compression process. The hot, high pressure vapor is then circulated through the condenser wherein in passes in heat exchange relationship with ambient air drawn or blown across through the condenser by a fan disposed in operative association with the condenser. As a result, the refrigerant is cooled and condensed back to the liquid phase and then passed through an expansion device which reduces both the pressure and the temperature of the liquid refrigerant before it is circulated back to the evaporator.

In conventional practice, the condenser comprises a plurality of tubes with fins extending across the flow path of the ambient air stream being drawn or blown through the condenser. A fan, disposed in operative association with the condenser, passes ambient air from the local environment through the condenser. U.S. Pat. No. 3,462,966 discloses a refrigerated glass door merchandiser having a condenser with staggered rows of finned tubes and an associated fan disposed upstream of the condenser that blows air across the condenser tubes. U.S. Pat. No. 4,977,754 discloses a refrigerated glass door merchandiser having a condenser with in-line tube rows and an associated fan disposed downstream of the condenser that draws air across the condenser tubes. A problem associated with conventional condensers is that over time dust, grease and other matter carried in the ambient air passing through the condenser collects on the condenser tubes. This air side fouling is problematic in that as the dust and other matter build up on the outside of the condenser tubes, heat transfer between refrigerant flowing through the tubes and the ambient air passing over the tubes decreases thereby degrading overall condenser performance.

SUMMARY OF THE INVENTION

It is an object of this invention to provide a refrigerated cold beverage merchandiser having a condenser that resists air side fouling.

A refrigerated cold beverage merchandiser is provided having an insulated enclosure defining a product display cabinet and a compartment separate from the insulated enclosure wherein a compressor, condenser and condenser fan are housed. The insulated enclosure has an access opening, which preferably has one or more doors that may be opened by the customer to access product shelved within the refrigerated display cabinet. The condenser comprises a plurality of tube rows disposed in an inline arrangement extending between opposite side end plates with the tubes being bare, non-finned tubes. The condenser fan is disposed adjacent the condenser and is encompassed by a shroud which extends to and mates with the condenser end plates whereby the air flow is channeled through the condenser.

DESCRIPTION OF THE DRAWINGS

For a further understanding of the present invention, reference should be made to the following detailed description of a preferred embodiment of the invention taken in conjunction with the accompanying drawings wherein.

DESCRIPTION OF THE PREFERRED EMBODIMENT

Figure 1:
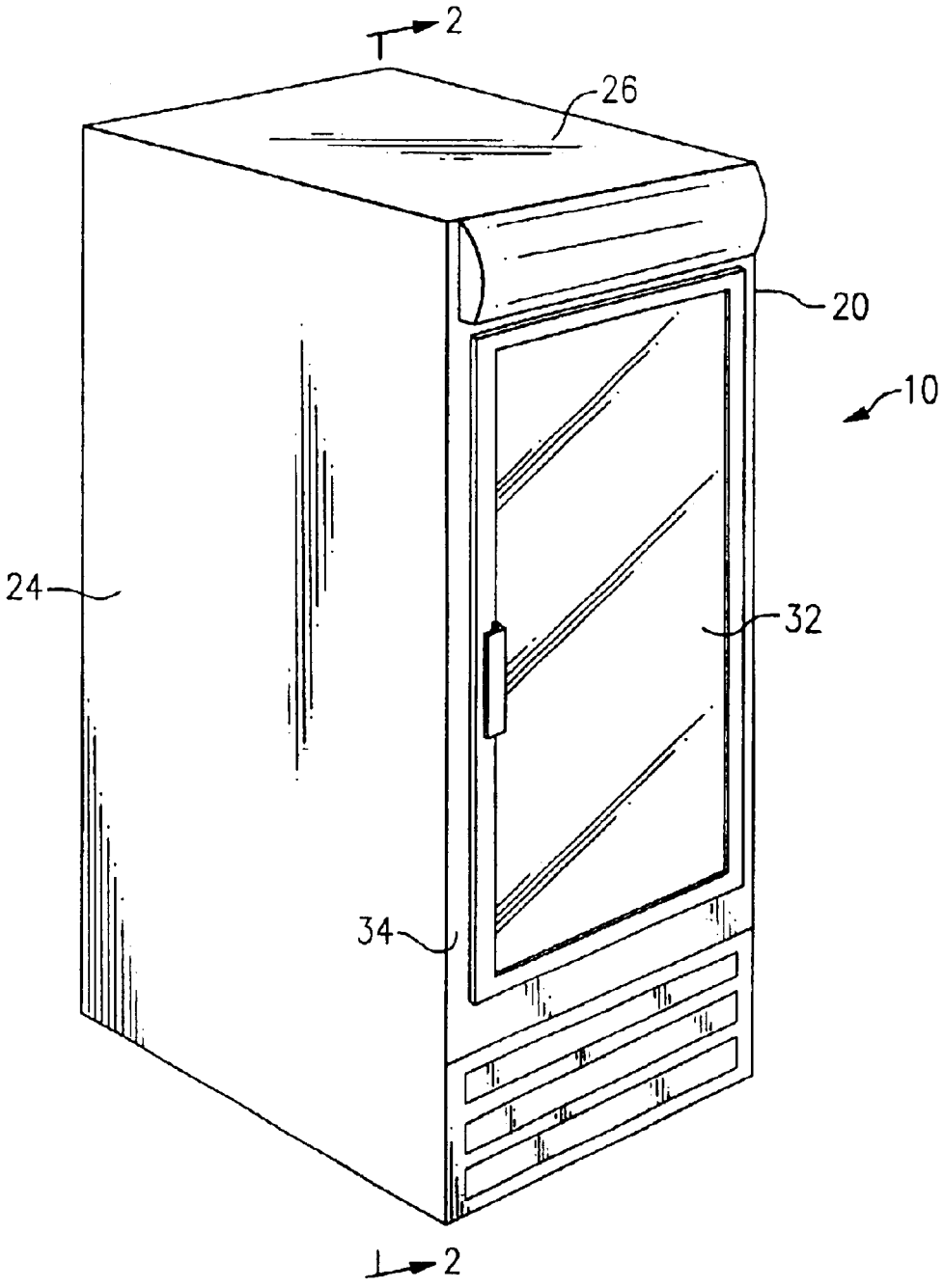
FIG. 1 is a perspective view from the front and the side of a refrigerated beverage merchandiser.
Figure 2:
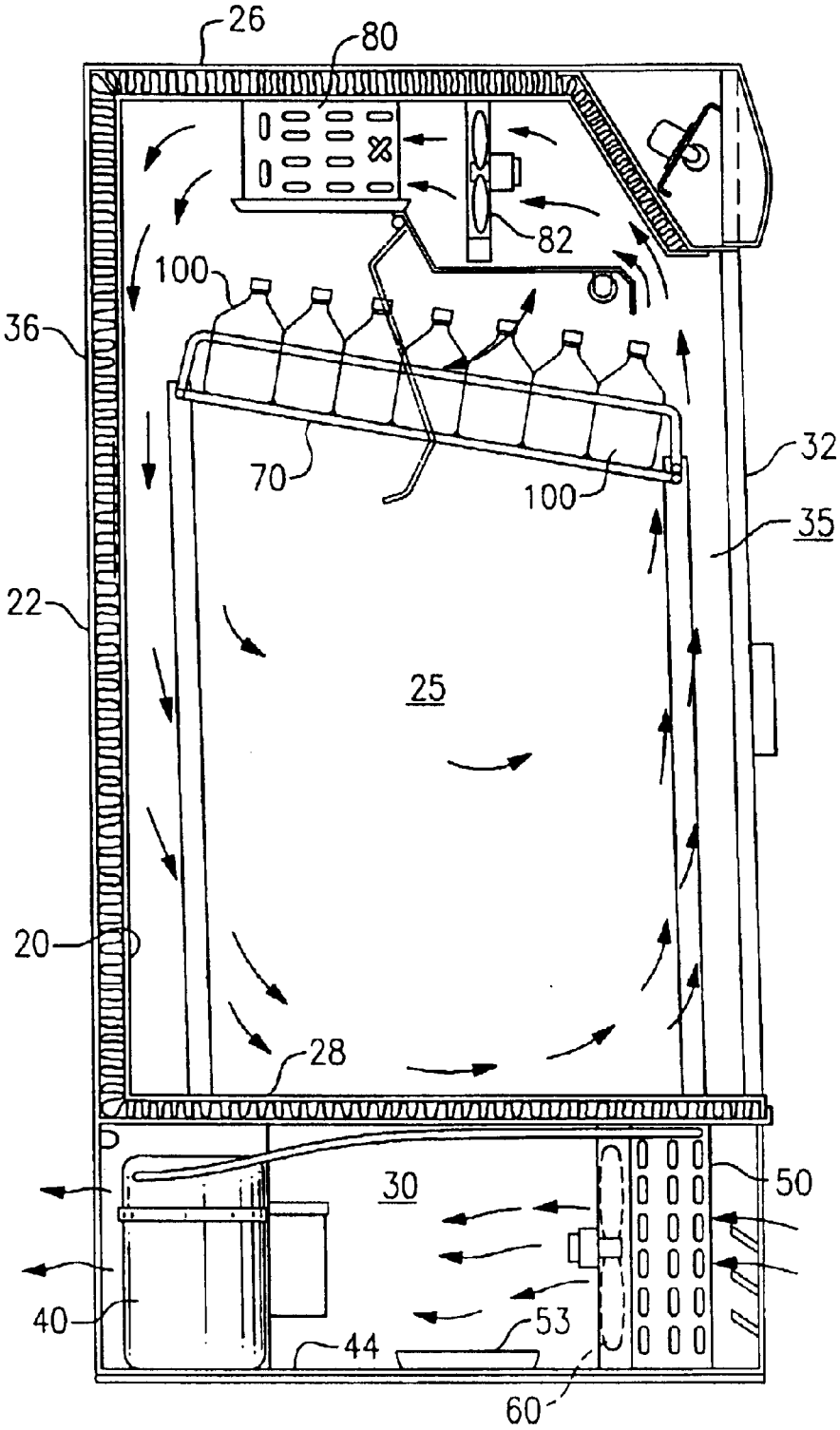
FIG. 2 is a sectional, side elevation view of the refrigerated beverage merchandiser taken along line 2—2 of FIG. 1 showing the condenser and fan assembly.

Referring now to FIGS. 1 and 2, there is depicted therein a refrigerated cold beverage merchandiser generally designated by the numeral 10. The beverage merchandiser 10 includes an enclosure 20 defining a refrigerated display cabinet 25 and a separate utility compartment 30 disposed externally of and heat insulated from the refrigerated display cabinet 25 and advantageously disposed beneath the refrigerated display cabinet 25. A compressor 40, a condenser 50, a condenser pan 53 and an associated condenser fan 60 are housed within the compartment 30. A mounting plate 44 may be disposed beneath the compressor 40, the condenser 50, and the condenser fan 60. Advantageously, the mounting plate 44 may be slidably mounted within the compartment 30 for selective disposition into and out of the compartment 30 in order to facilitate servicing of the refrigeration equipment mounted thereon.

The refrigerated display cabinet 25 is defined by an insulated rear wall 22 of the enclosure 20, a pair of insulated side walls 24 of the enclosure 20, an insulated top wall 26 of the enclosure 20, an insulated bottom wall 28 of the enclosure 20 and an insulated front wall 34 of the enclosure 20. Heat insulation 36 (shown by the looping line) is provided in the walls defining the refrigerated display cabinet 25. Beverage product 100, such as for example individual cans or bottles or six packs thereof, are displayed on shelves 70 mounted in a conventional manner within the refrigerated display cabinet 25, such as for example in accord with the next-to-purchase manner shown in U.S. Pat.

No. 4,977,754, the entire disclosure of which is hereby incorporated by reference. The insulated enclosure 20 has an access opening 35 in the front wall 34 that opens to the refrigerated display cabinet 25. If desired, a door 32, as shown in the illustrated embodiment, or more than one door, may be provided to cover the access opening 35. It is to be understood however that the present invention is also applicable to beverage merchandisers having an open access without a door. To access the beverage product for purchase, a customer need only open the door 32 and reach into the refrigerated display cabinet 25 to select the desired beverage.

An evaporator 80 is provided within the refrigerated display cabinet 25, for example near the top wall 26 thereof in association with an evaporator fan 82, as illustrated in FIG. 2. The fan is operative to circulate air within the refrigerated display cabinet 25 through the evaporator 80. As the circulating air passes through the evaporator 80, it passes in a conventional manner in heat exchange relationship with refrigerant circulating through the tubes of the evaporator as is cooled as a result. The cooled air leaving the evaporator 80 is directed downwardly in a conventional manner into the cabinet interior to pass over the product 100 disposed on the shelves 70 before being drawn back upwardly to again pass through the evaporator.

Refrigerant is circulated in a conventional manner between the evaporator 80 and the condenser 50 by means of the compressor 40 through refrigeration lines forming a refrigeration circuit (not shown) interconnecting the compressor 40, the condenser 50 and the evaporator 80 in refrigerant flow communication. As noted before, cold liquid refrigerant is circulated through the evaporator 80 to cool the air within the refrigerated display cabinet 25. As a result of heat transfer between the air and the refrigerant passing in heat exchange relationship in the evaporator 80, the liquid refrigerant evaporates and leaves the evaporator as a vapor. The vapor phase refrigerant is then compressed in the compressor 40 to a high pressure, as well as being heated to a higher temperature as a result of the compression process. The hot, high pressure vapor is then circulated through the condenser 50 wherein in passes in heat exchange relationship with ambient air drawn or blown across through the condenser 50 by the condenser fan 60.

Figure 3:
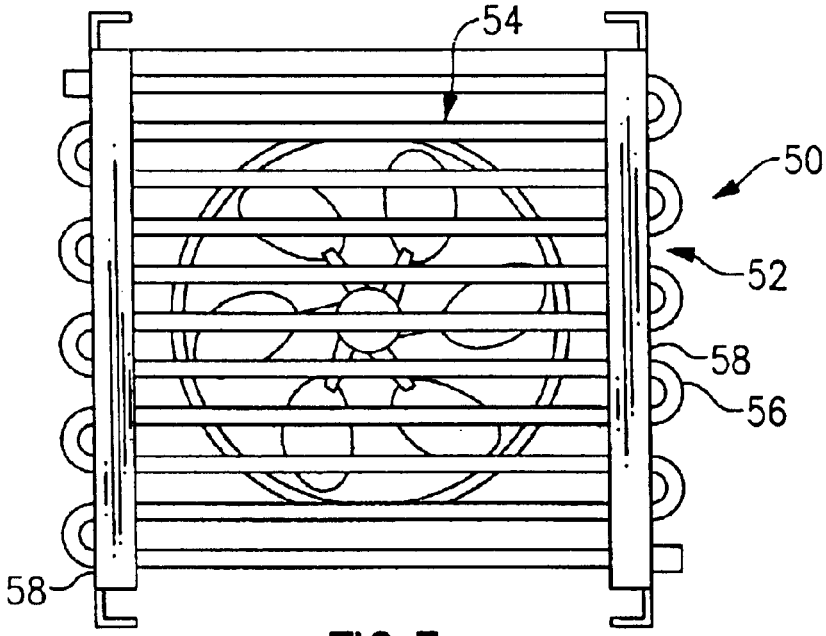
FIG. 3 is a elevation view partly in section taken along 3—3 of FIG. 1 showing the condenser of the present invention.
Figure 4:
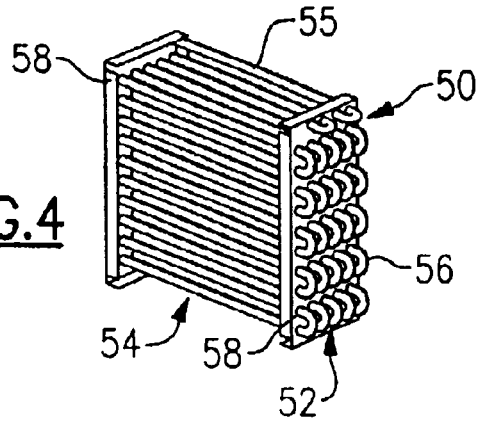
FIG. 4 is a perspective view of the condenser of FIG. 3.
Figure 5:
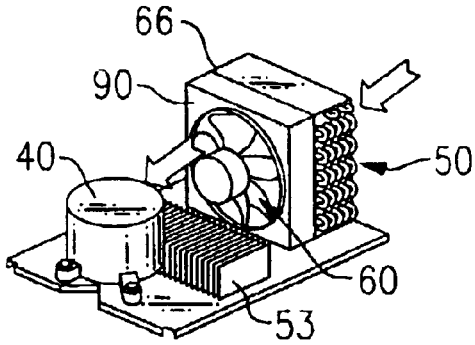
FIG. 5 is a perspective view of the condenser-fan assembly of the refrigerated beverage merchandiser of FIG. 1.

Referring now to FIGS. 2, 3 and 4, in particular, the condenser 50 comprises a plurality of in-line tube banks 52. Each tube bank 52 comprises a serpentine tube formed a plurality of parallel straight tube segments 54 extending in horizontal rows 55 between a pair of spaced, opposed end plates 58 and elbow turns 56 connecting neighboring straight tube segments 56 in a conventional manner. Each successive tube bank 52 is aligned with the other tube banks so that respective parallel tube rows 55 are disposed in-line from the front to the rear of the condenser 50. In this arrangement, as best seen in FIG. 3, the open free air flow area through the condenser 50 is maximized for a given overall face area extending between the spaced end plates 58, the base plate 44 and the top plate 66 which extends between the end plates 58 over the top of the condenser tube banks 52, while the air flow area that is blocked is minimized. By minimizing the blocked flow area and maximizing the open flow area, the tendency of dust, grease and other debris in the ambient air flow passing through the condenser to deposit onto to the tubes is significantly reduced, thereby providing a relatively foul-free condenser design.

Although shown and described herein with the tube rows 55 disposed horizontally, it is to be understood that the condenser tube banks 52 could readily be orientated with the tube rows 55 disposed vertically. Further, the condenser 50 may consist of any number of tube banks and any number of tube rows within the tube banks and any length for the tube rows, as desired, as long as the tube rows are aligned in-line from tube bank to tube bank.

The condenser fan 60 is disposed adjacent the condenser 50 and advantageously downstream with respect to air flow of the condenser 50 so as to draw the air flow through the condenser tube banks 52. The condenser fan 60 is encompassed by a shroud 90 which mates at its forward edge with the end plates 58 and the top plate 66 encompassing the condenser tube banks 52. Alternatively, the fan shroud 90 may incorporate the top plate 66 as a plate extending forwardly from the upper edge of the fan shroud. Together the fan shroud 90, the condenser top plate 66, the condenser end plates 58 and the base plate 44 form in effect a tunnel through which ambient flow is channeled through the open flow area between the tube rows 55 of the condenser 50. It is believed that such channeling of the air flow therethrough results in less turbulence as the air flow passes through the condenser 50 thereby channeling dust, grease and other debris through the open flow area between the tube rows 50, as opposed to more likely contacting the tubes as would be the case in a more turbulent flow or in a conventional prior art condenser having staggered tube rows from tube bank to tube bank.

What is claimed is:

1. A refrigerated merchandiser comprising:

an enclosure having a rear wall, a bottom wall, a top wall, a pair of side walls and a front wall defining a refrigerated display cabinet and having an access opening in said front wall for providing access to the refrigerated display cabinet;

an evaporator disposed in operative association with the refrigerated display cabinet;

a compartment heat insulated from the refrigerated display cabinet;

a condenser mounted to a base plate disposed within said compartment, said condenser having a plurality of non-finned tube banks, each tube bank having a plurality of parallel, straight non-finned tube rows extending between a pair of spaced end plates, the tube banks being disposed such that respective tube rows are aligned in an in-line arrangement;

a condenser fan mounted to the base plate disposed within said compartment in operative association with said condenser, said condenser fan disposed downstream with respect to airflow of said condenser so as to draw airflow through the non-finned tube banks of said condenser;

a compressor mounted to the base plate disposed within said compartment and connected in refrigerant flow communication with said evaporator and said condenser for circulating refrigerant through said evaporator and said condenser; and a top plate extending between the condenser end plates over said plurality of condenser tube banks, and a shroud encompassing said condenser fan and mating with the condenser end plates and top plate thereby forming with the base plate tunnel about said condenser and said condenser fan.

2. A refrigerated merchandiser as recited in claim 1 wherein the base plate is slidably removable from the compartment with said compressor, said condenser and said condenser fan.

* * * * *